US010449111B1

(12) United States Patent
Callow

(10) Patent No.: US 10,449,111 B1
(45) Date of Patent: Oct. 22, 2019

(54) THRUST BUMPER AND SYSTEM AND METHOD OF SEXUAL INTERCOURSE

(71) Applicant: Perfect Fit Brand, Inc., Boca raton, FL (US)

(72) Inventor: Stephen Callow, Fort Lauderdale, FL (US)

(73) Assignee: Perfect Fit Brand, Inc., Fort Lauderdale, FL (US)

( * ) Notice: Subject to any disclaimer, the term of this patent is extended or adjusted under 35 U.S.C. 154(b) by 0 days.

(21) Appl. No.: 15/792,284

(22) Filed: Oct. 24, 2017

(51) Int. Cl.
*A61H 19/00* (2006.01)

(52) U.S. Cl.
CPC ..... *A61H 19/50* (2013.01); *A61H 19/30* (2013.01); *A61H 2201/1628* (2013.01)

(58) Field of Classification Search
CPC ..... A61H 19/50; A61H 19/32; A61F 5/41; A61F 2005/411; A61F 2005/414; A61F 2005/417; A61F 2/0054; A47G 9/10
See application file for complete search history.

(56) References Cited

U.S. PATENT DOCUMENTS 6,306,080 B1 * 10/2001 Mitchell ..... A61F 5/41 600/38
2004/0236179 A1 * 11/2004 Egretier ..... A61F 5/41 600/38
2007/0283965 A1 * 12/2007 Foks ..... A61H 19/50 128/845
2013/0296645 A1 * 11/2013 Evans ..... A61H 19/50 600/41
2016/0022534 A1 * 1/2016 Fryman ..... A61H 19/50 600/38

OTHER PUBLICATIONS

Master Series, "Annex Erection Enhancer", Jun. 29, 2016, accessed from archive.org, one page.*

* cited by examiner

*Primary Examiner* — Kari K Rodriquez
(74) *Attorney, Agent, or Firm* — Peter A. Koziol

(57) ABSTRACT

A thrust bumper device, system and method for sexual intercourse using a thrust bumper device and optional extension wherein a thrust bumper comprises a distal part; an inner part; a proximal part; and, a penile port; wherein: a phallus is inserted in the penile port on the distal part by a penetrating party; the tip of the phallus penetrates through the thrust bumper and is inserted into an orifice of a receiving party, and the thrust bumper and/or its optional extension buffer increases comfort and pleasure during sexual intercourse.

11 Claims, 17 Drawing Sheets

FIG. 7
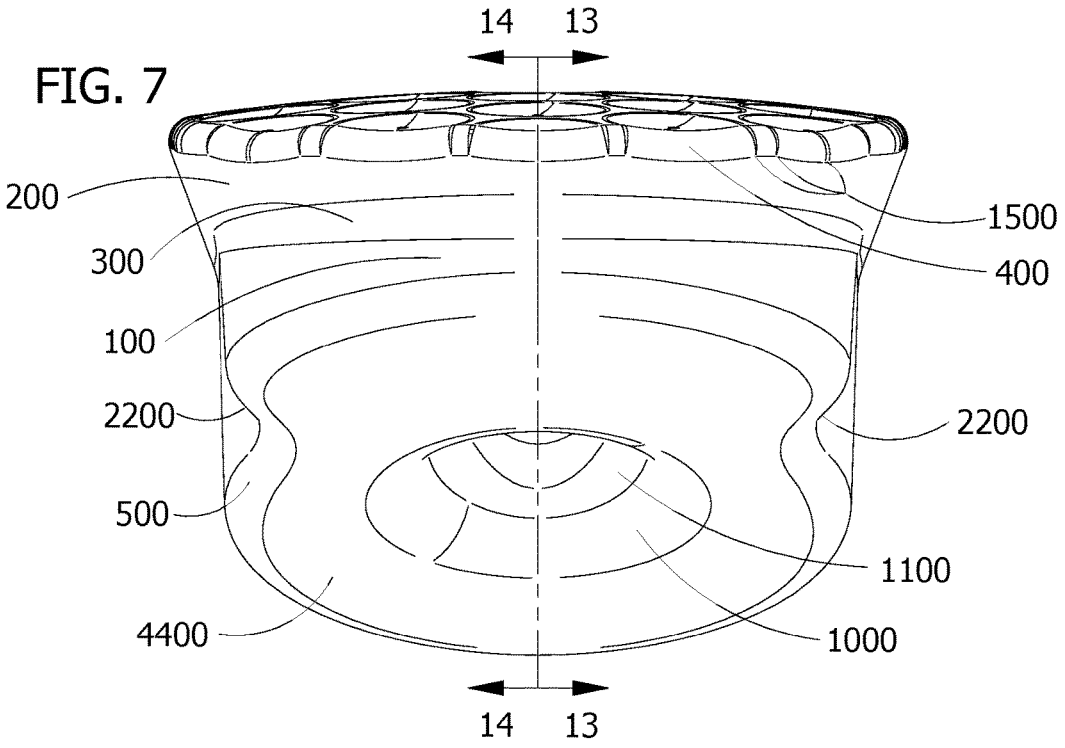
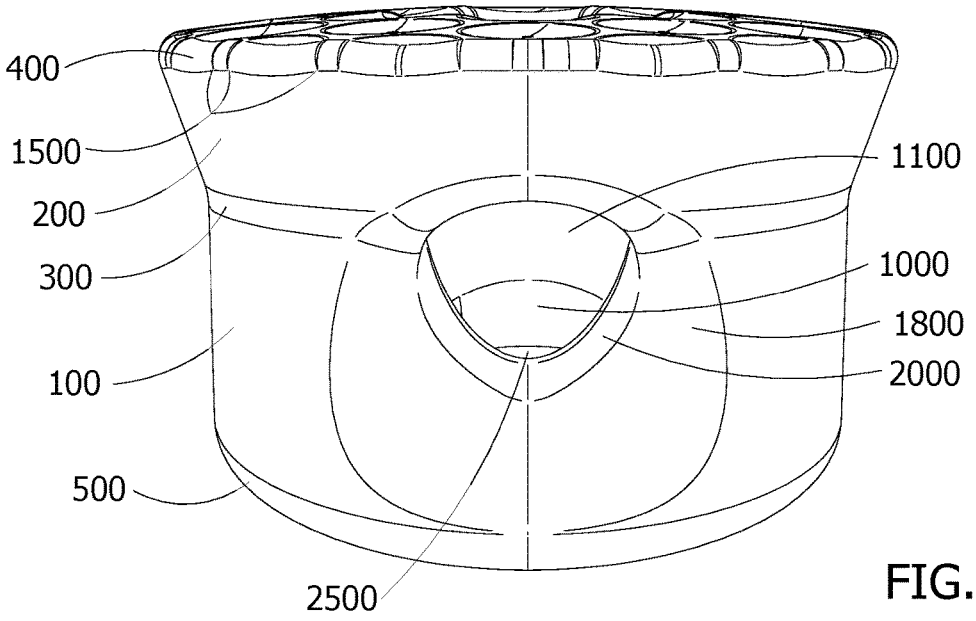
FIG. 8

FIG. 9
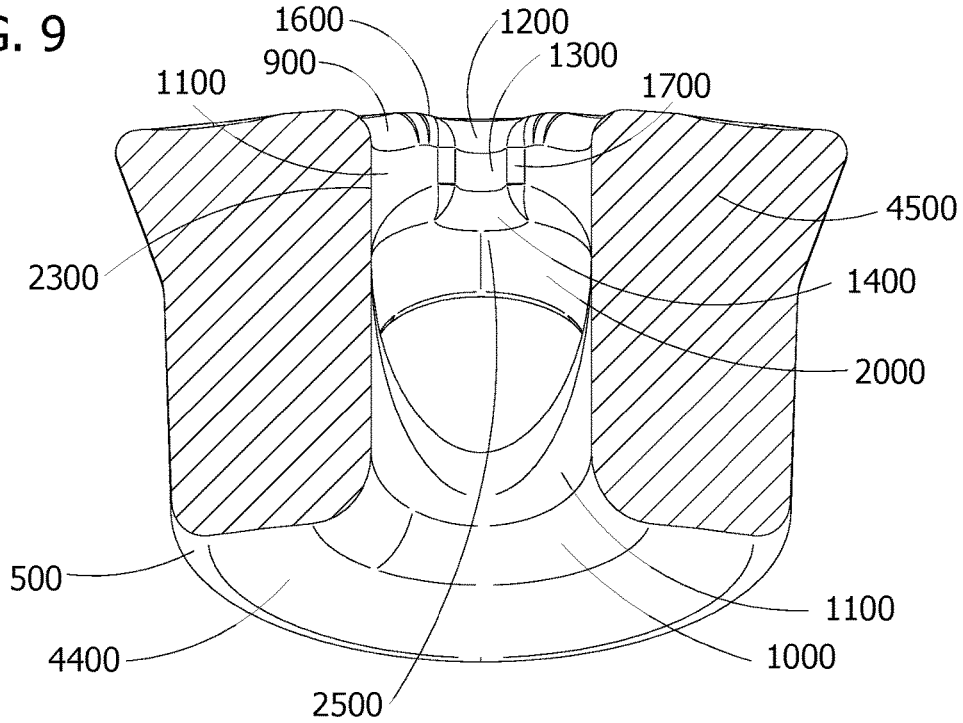
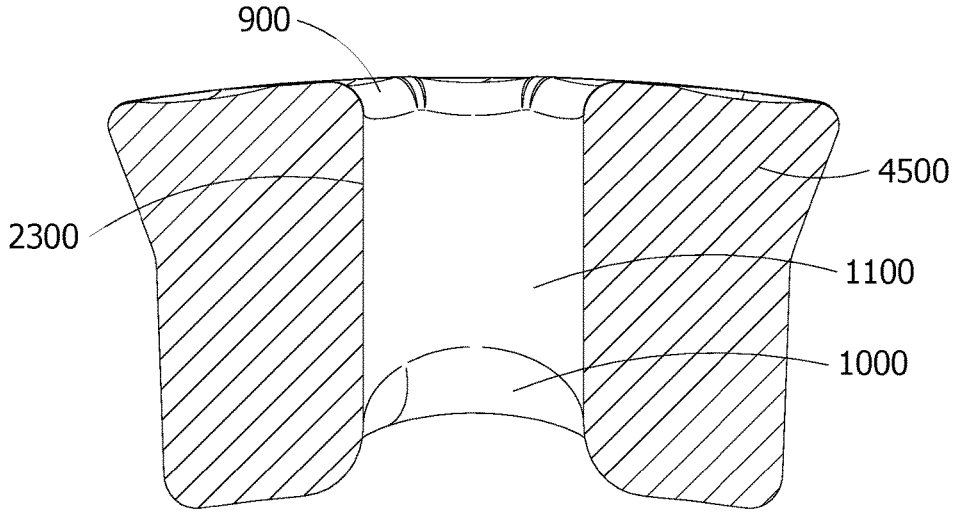
FIG. 10

FIG. 27
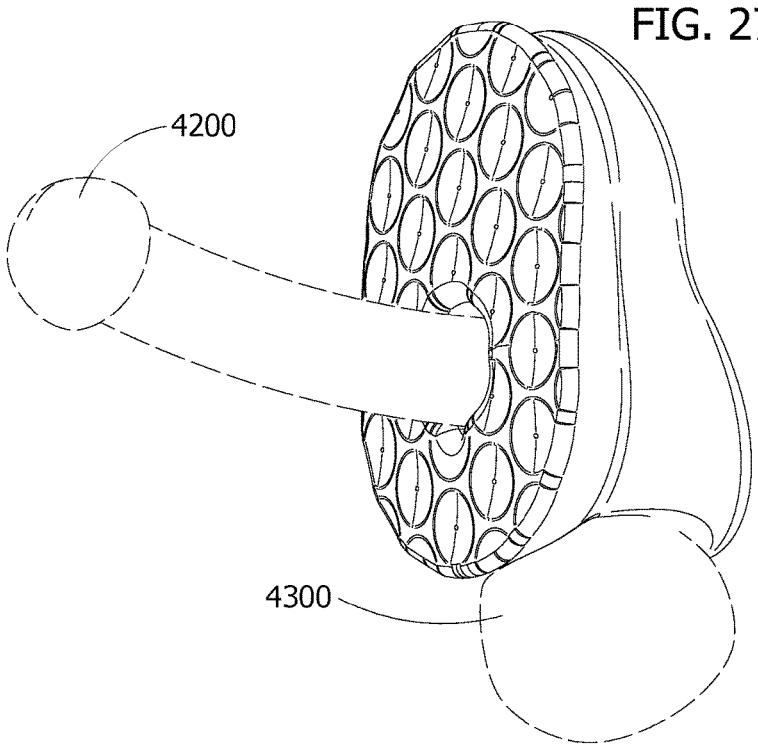
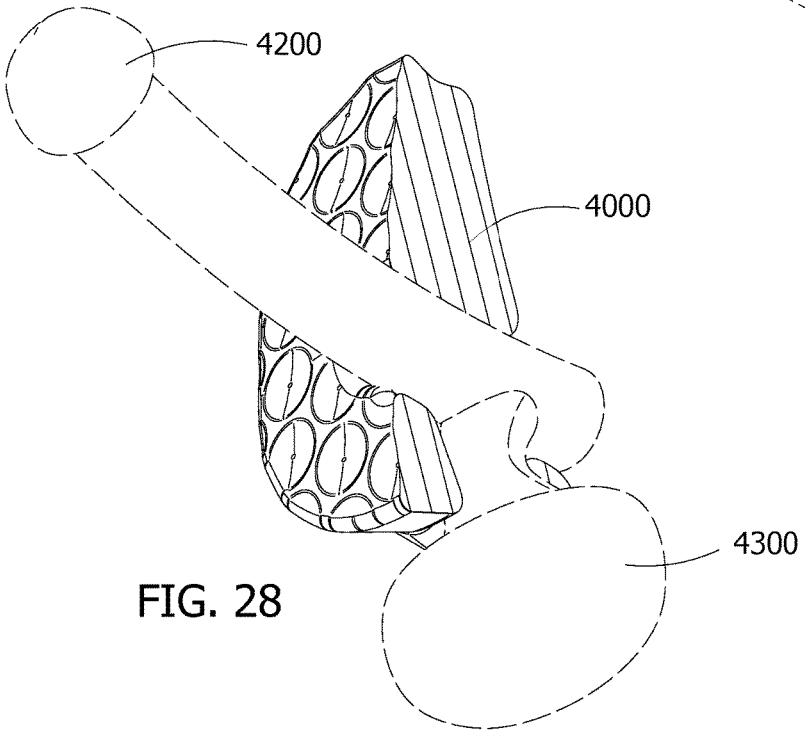
FIG. 28

THRUST BUMPER AND SYSTEM AND METHOD OF SEXUAL INTERCOURSE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to the fields of sexual health devices, systems and methods for sexual intercourse. Using of the invention during sexual intercourse maximizes comfort and pleasure and reduces injury and pain.

Description of the Related Art

It has long been taught in the art of sexual intercourse that bigger is better. Stronger and harder is best. Hot and wet is encouraged and sought. However, injury and discomfort can come from large hard penises and rough intercourse. Bodies slamming against other bodies can cause pleasure or pain, bruising and injury. In some cases death has resulted and legends and myths told (e.g. Catherine the Great). Despite the teachings of the art, there has been a long unmet need to prevent injury, pain and discomfort when the penis is too big, too hard, or the sexual intercourse too rough. Furthermore, some persons do not like sexual intercourse that is too hot, too cold or too wet.

SUMMARY OF THE INVENTION

The present invention is a thrust bumper. A thrust bumper overcomes the problems with the prior art by providing a comfortable, well fitted, non-slip, pad/buffer that is used during sexual intercourse. A thrust bumper is placed between a penetrating/giving partner and a receiving/penetrated partner engaged in sexual activity and provides a comfortable solution that reduces injury from sexual activity. A thrust bumper is particularly well adapted to prevent injury where a phallus is driven too deep and/or hard into an orifice and discomfort is caused to the penetrated partner within and around the orifice by friction, rough and/or deep thrusting. A thrust bumper also provides a comfortable surface surrounding the phallus and scrotal sac to prevent injury where the area surrounding the orifice is course, rough, hairy or too hard. A thrust bumper can also be used by sexual partners to reduce contact with wet surfaces and control the temperature at the site of sexual intercourse. Furthermore, a thrust bumper provides a novel, unique, intimate and customizable sexual experience. A thrust bumper is used with various attachments, including buffers (that when in the shape of a torus are called donuts and o-rings) that provide additional support and or buffering between a phallus and a orifice. A thrust bumper provides a comfortable method of distributing sexual energy in a pleasurable manner. A thrust bumper enables a sexual experience to be comfort adjusted for the desires, comfort and perfect fit of sexual partners. A thrust bumper can be constructed in a low cost, efficient manner, is discrete and is easy to transport.

More specifically, a thrust bumper serves as a cushion between two partners to absorb some of the bumping and provide the sensation of maximum depth for the penis. A thrust bumper cushions deep thrusts during intercourse, providing more passionate sex without restraint. Receiving partners who express discomfort during intercourse with a partner find pleasure in a thrust bumper's ability to make sex more enjoyable within their comfort zone. Whereas, penetrating partners still have the feeling of full insertion and intimate contact with their receiving partner without having to hold back. For women, the thrust bumper promotes sexual health and lessens the chances of a bruised cervix. For men it provides additional simulation of the penis and the scrotum, particularly when a thrust bumper fits around the penis and is held in place by the testicles.

A thrust bumper system utilizes multiple parts including: the base "bumper" unit and one or more optional buffers/extenders. Each part of the thrust bumper system can be used independently or together to create a thick and protective cushion for when the thrusts go deep. Notably, the thrust bumper system is designed to be adjustable so users can add more cushions, called buffers and/or donuts, to suit their depth preferences/requirements. Said buffers are shown in the drawings as toroids, but buffers in various three dimensional forms including but not limited to cubes, cones, cylinders and spheres are also used.

With the invention of the thrust bumper, now sexual partners can try previously avoided positions with new confidence and pleasure.

Although the invention is illustrated and described herein as embodied as a trust bumper, the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

BRIEF DESCRIPTION OF THE DRAWINGS

Features and advantages of the present invention will become apparent to those skilled in the art from the following description with reference to the drawings, in which:

FIG. 7 is a top down view of the invention of FIG. 1;

FIG. 8 is a proximal up view of the invention of FIG. 1;

FIG. 9 is a cutaway view of the top down view of FIG. 7 of the invention of FIG. 1;

FIG. 10 is a cutaway view of the proximal up view of FIG. 8 of the invention of FIG. 1;

FIG. 27 shows a thrust bumper system as donned by a phallus.

FIG. 28 shows a cut away view of FIG. 27.

DETAILED DESCRIPTION OF THE INVENTION

Figure 1:
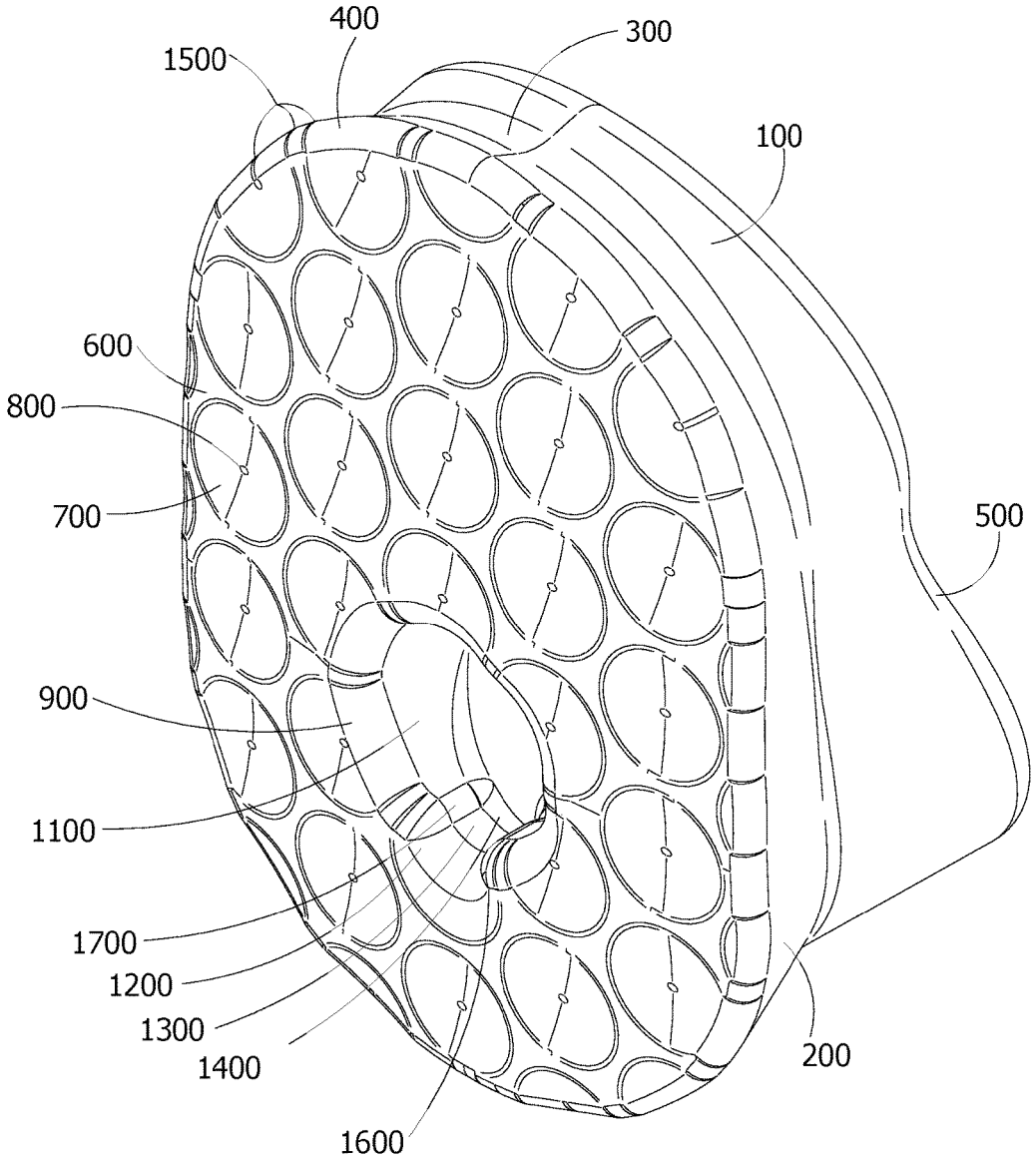
FIG. 1 is an elevated distal view of the thrust bumper of the present invention.

Referring to the drawings, FIG. 1. shows an elevated distal view of a thrust bumper. When donned by a penetrating partner the distal side of the thrust bumper generally faces away from the penetrating partner. However, some embodiments of the thrust bumper are reversible and may be donned by the receiving partner and/or reversed so that the distal end faces towards the penetrating partner. The parts of the thrust bumper shown and labeled in FIG. 1. are comprised of a: proximal part 100; a distal part 200; a midsection 300; distal exterior edge 400; proximal exterior edge 500; distal surface 600; surface mound 700; mound center 800; distal interior edge 900; proximal interior edge 1000; interior wall 1100; distal edge of urethral channel 1200; interior urethral channel 1300; proximal urethral channel 1400; distal exterior edge groove 1500; distal interior edge groove 1600; and, urethral channel sidewall 1700.

As shown in the drawings a proximal part 100 a distal part 200, and a midsection 300 are generally formed together. A distal exterior edge 400 and proximal exterior edge 500 traverse the respective perimeters of a distal part 200 and proximal part 100. Together a proximal part 100; a distal part 200; a midsection 300; distal exterior edge 400; proximal exterior edge 500 and outer surface generally form a wedge shape. However, the wedge shape can be replaced with various forms such as cylindrical, toroidal, pyramidal, cubical, etc.

In the interior of a distal part 200, midsection 300 and proximal part 100 are a: distal interior edge 900; proximal interior edge 1000; interior wall 1100; distal edge of urethral channel 1200; interior urethral channel 1300; proximal urethral channel 1400; and, urethral channel sidewall 1700. These interior parts form and surround a penile channel.

In a preferred embodiment, a thrust bumper is made of a single material from a single mold. The material used for a thrust bumper may be nearly any solid material. However, a material used often has elastic properties in order to absorb energy and stretch to fit. In a preferred embodiment a thrust bumper fits around a penis and is held in place by the testicles. This preferred embodiment provides an added benefit of enabling the automatic massaging, squeezing and pulling sensation around the testicles and/or perineum during intercourse that provides pleasure to the penetrating partner donning the device, similar to that of a reach around. For the penetrated/receiving partner that would normally provide a reach around, the device enables the penetrated partner to use their hands for other purposes, or for more specific stimulation of the penetrating partner's testicles and perineum which although automatically stimulated are still accessible to the penetrated partner.

A preferred material for forming a thrust bumper contains polysiloxanes, a silicone plastic and/or silicone rubber blend. Various elastomers may also be used, including but not limited to natural rubbers. Ideally, in many cases, an inert or medical grade silicone rubber, latex or silicone blended material is used. The recommended materials for forming a thrust bumper are biocompatible and hypoallergenic, but can also be treated with an antibiotic or antiviral coating and/or texture. Antibiotic material and/or chemicals may also be infused or formed within the material of the thrust bumper. Springs, foams, padding, goose down, cotton, rayon, polyester, various microfibers and other materials such as memory foam may be used to form the thrust bumper and/or portions of its core.

The thrust bumper core may contain gels, liquids and/or other materials. However, too much memory or too much elasticity of the material that comprise a thrust bumper may adversely effect the results. Moreover, many springs, foams, padding and other materials often lack the generally desired hypoallergenic characteristics. The best materials generally are: highly elastic; quickly to return to their stable (molded or cut) form; resist/prevent and/or destroy bacteria, fungus and viruses; and, are easily washed. A preferred embodiment of a thrust bumper compresses during thrusting of sexual intercourse and expands during withdraw. Generally, the material forming a thrust bumper should feel comfortable to the touch and soft, silky, and skin like. However, some users desire a more rigid, leathery or rough feel.

As shown in FIG. 1, a midsection 300 is sandwiched in between a distal part 200 and proximal part 100. A midsection 300, distal part 200 and proximal part 100 are preferably formed as one piece and fully integrated. Depending on the method of manufacture and use, a singular object may form a distal part 200, proximal part 100 and midsection 300. Generally, as shown in FIG. 1, a distal part 200, proximal part 100 and midsection 300 of a thrust bumper are regions of a single object. However, each of these regions may have their own individual structure and/or frame. In many embodiments, a distal part 200, proximal part 100 and midsection 300 share the same surface material as shown in FIG. 1. In a preferred embodiment, a distal part 200, proximal part 100 and midsection 300 consist entirely of a uniform material.

In one embodiment, the distal surface contains one or more surface mounds 700. In such embodiment, each surface mound 700 generally has a mound center 800. However, in another embodiment the surface mounds 700 may be inverted to become surface depressions. Generally, the mound centers 800, are located at the highest point or lowest point of the respective mound or depression. However, in some embodiments such minima and maxima points are off center of the mounds and/or depressions. Although depicted in the drawings as circular structures, the mounds and/or depressions can be of other shapes and forms such as ellipses, boxes, cylinders, pyramids, etc. The mound and depressions are also alternated in some embodiments so that the distal surface has both mounds and depressions. Furthermore, the optional surface mounds 700 may be replaced with suction cups, hooks and loops and/or other surface features. These surface features generally reduce slippage between a thrust bumper and a receiving partner and/or a thrust bumper and its optional buffers and extenders.

Figure 2:
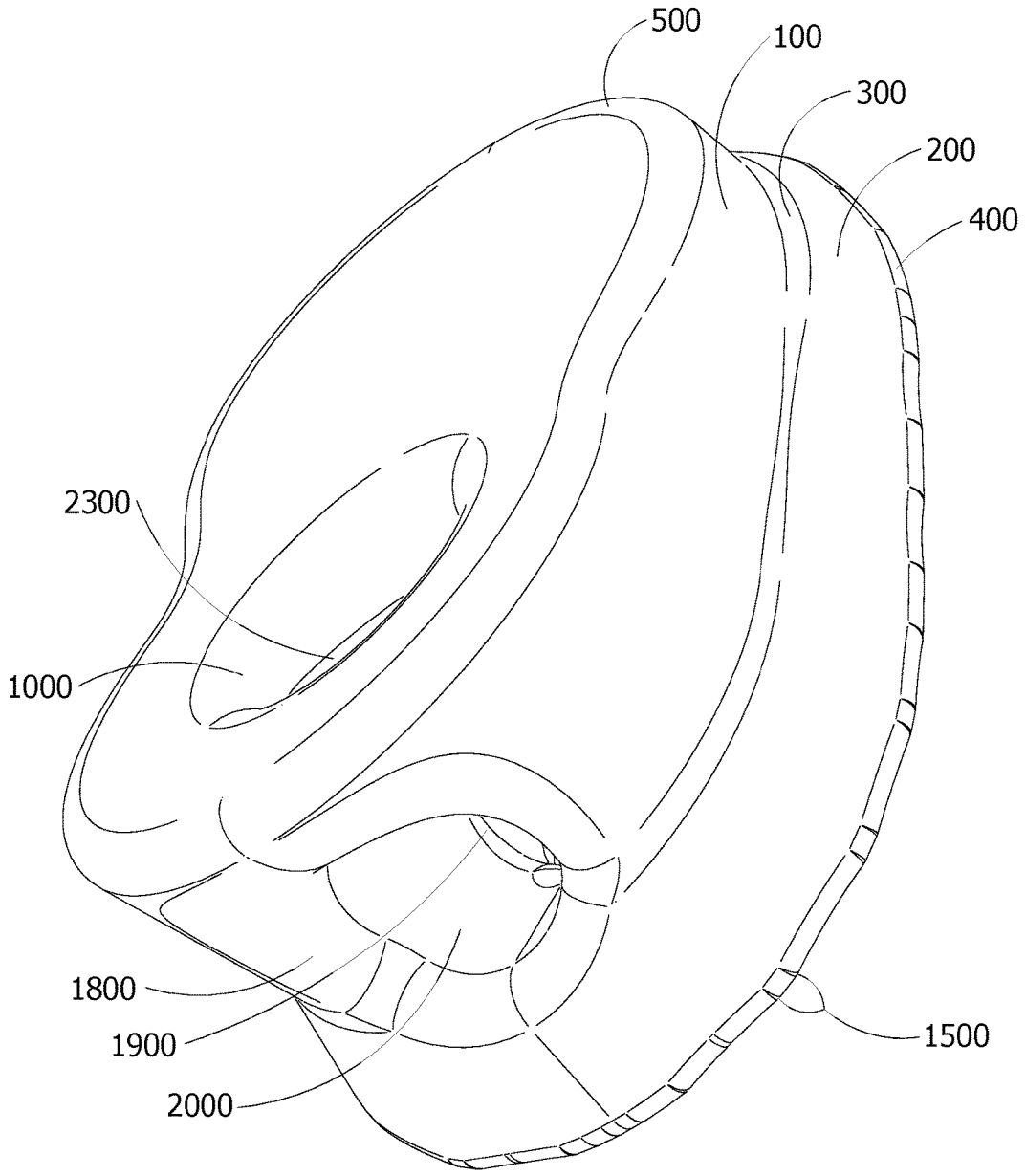
FIG. 2 is an elevated proximal view of the invention shown in FIG. 1.

FIG. 2 is an elevated proximal view of the invention shown in FIG. 1. The parts of the thrust bumper shown and labeled in FIG. 2. are comprised of a: proximal part 100; a distal part 200; a midsection 300; distal exterior edge 400; proximal exterior edge 500; proximal interior edge 1000; proximal urethral channel 1500; scrotal port exterior edge 1800; scrotal port interior edge 1900; scrotal port interior wall 2000; and, penile port 2300.

Figure 3:
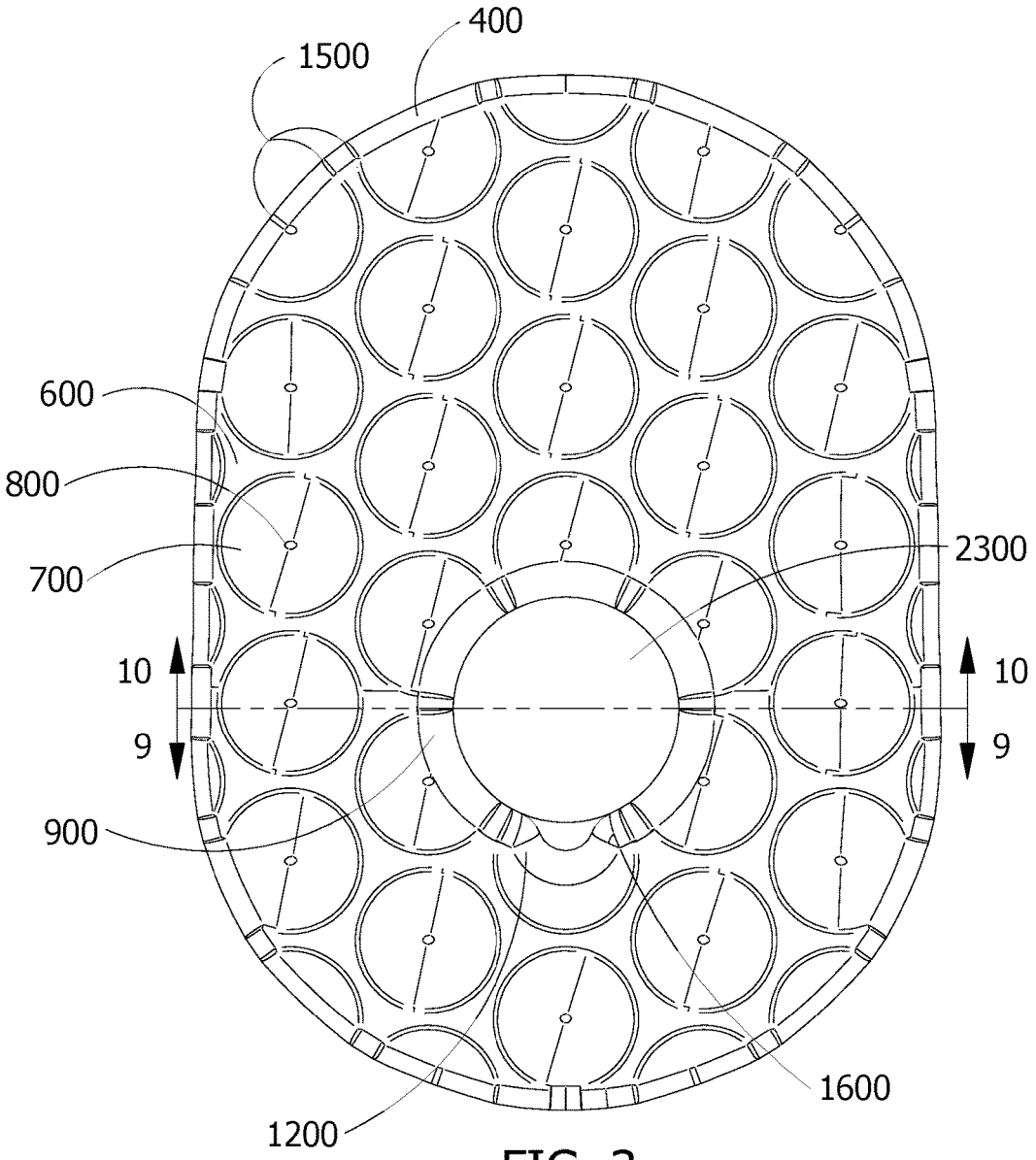
FIG. 3 is a distal view of the invention shown in FIG. 1.

FIG. 3 is a distal view of the invention shown in FIG. 1. The parts of the thrust bumper shown and labeled in FIG. 3. are comprised of a: distal exterior edge 400; distal surface 600; surface mound 700; mound center 800; distal interior edge 900; distal edge of urethral channel 1200; distal exterior edge groove 1500; distal interior edge groove 1600; and, penile port 2300.

Figure 4:
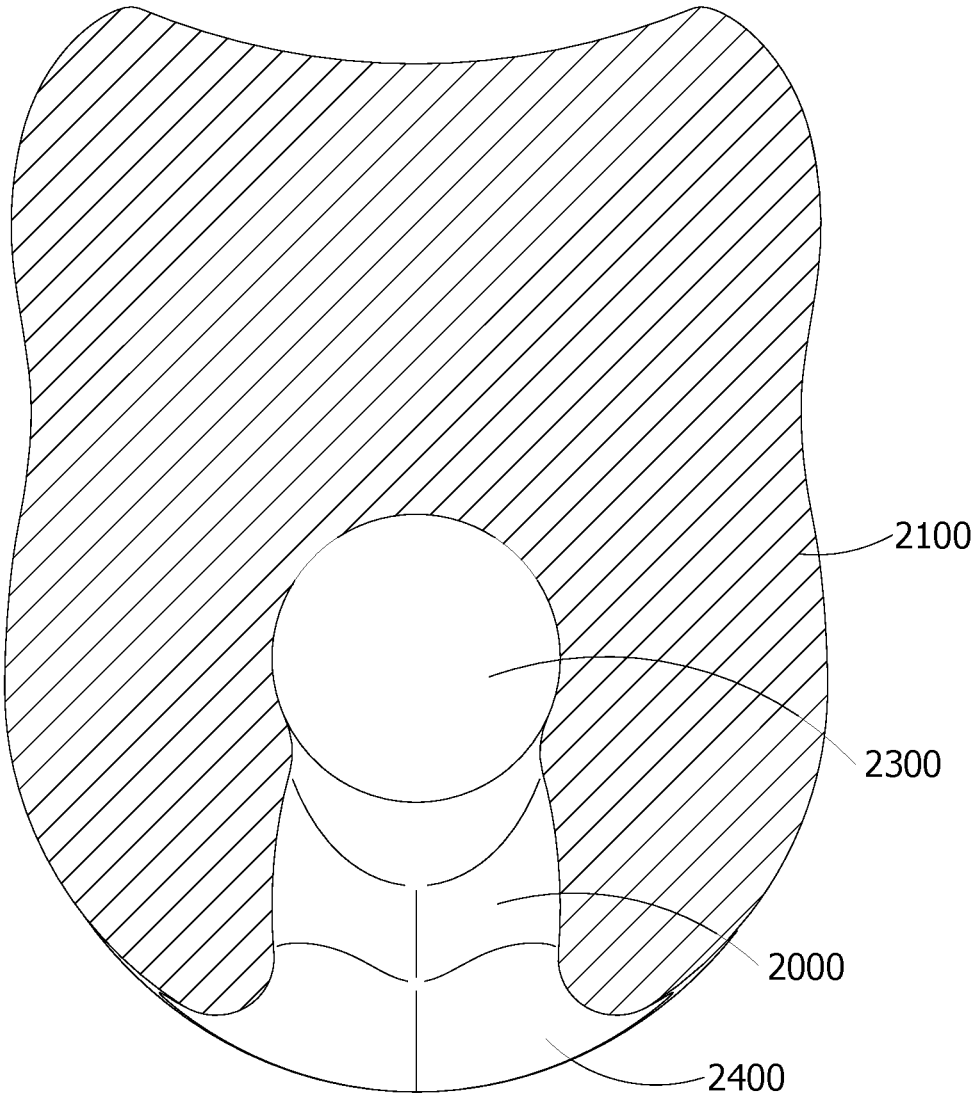
FIG. 4 is a cut away of the distal view of FIG. 3 and the invention shown in FIG. 1.

FIG. 4 is a cut away of the distal view of FIG. 3 and the invention shown in FIG. 1. The parts of the thrust bumper shown and labeled in FIG. 4. are comprised of: scrotal port inner wall 2000; mid section profile 2100; penile port 2300; and, distal scrotal port exterior edge 2400.

Figure 5:
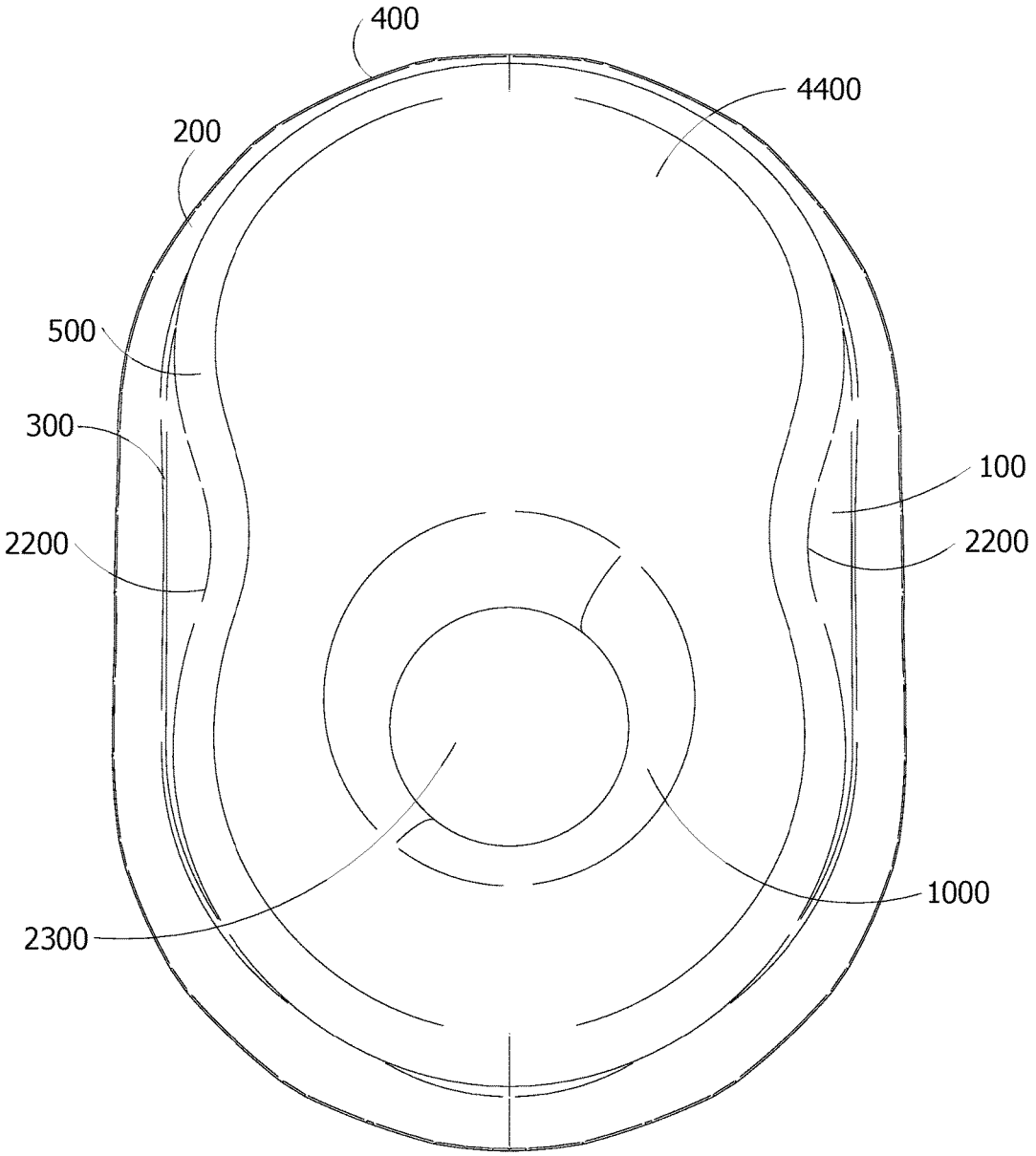
FIG. 5 is a proximal view of the invention shown in FIG. 1.

FIG. 5 is a proximal view of the invention shown in FIG. 1. The parts of the thrust bumper shown and labeled in FIG. 5. are comprised of a: proximal part 100; a distal part 200; a midsection 300; distal exterior edge 400; proximal exterior edge 500; proximal interior edge 1000; scrotal port exterior edge 1800; scrotal port interior edge 1900; indentation of the base wall 2200; penile port 2300; and, 4400 proximal surface. Although the proximal surface appears smooth in the drawings it may have various surface features and textures. It may also have surface mounds and/or depressions similar to those drawn on the distal surface in FIG. 1. The indentation of the base wall 2000 enables a better fit and reduces shifting of the thrust bumper during use. Such indentation of the base wall 2000 is in the proximal part and may occur on one or more sides of the proximal part and may also extend up through the midsection and/or distal part. As shown in the embodiment of FIG. 5. an indentation of the base wall 2000 may also taper into the midsection.

Figure 6:
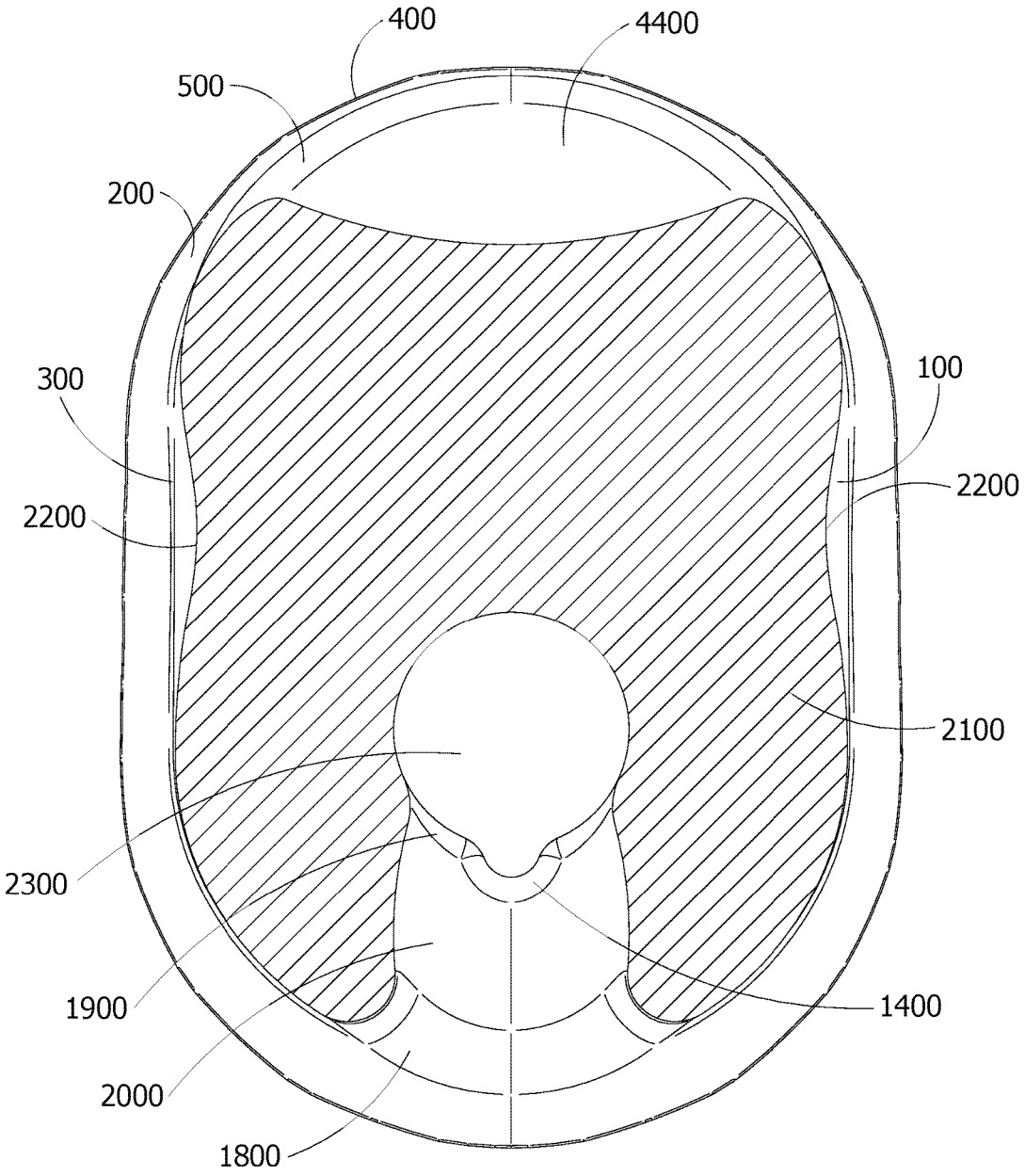
FIG. 6 is a cutaway of the proximal view of the FIG. 5 of the invention shown in FIG. 1.

FIG. 6 is a cutaway of the proximal view of the FIG. 5 of the invention shown in FIG. 1. The parts of the thrust bumper shown and labeled in FIG. 6. are comprised of a: proximal part 100; a distal part 200; a midsection 300; distal exterior edge 400; proximal exterior edge 500; proximal urethral channel 1400; scrotal port exterior edge 1800; scrotal port interior edge 1900; scrotal port inner wall 2000; mid section profile 2100; indentation of the base wall 2200; penile port 2300; and, 4400 proximal surface.

FIG. 7 is a top down view of the invention of FIG. 1. The parts of the thrust bumper shown and labeled in FIG. 7. are comprised of a: proximal part 100; a distal part 200; a midsection 300; distal exterior edge 400; proximal exterior edge 500; proximal interior edge 1000; interior wall 1100; distal exterior edge groove 1500; indention of the base wall 2200; and, proximal surface 4400. This view is referred to as a top down view, because when the penetrating party dons the device and is standing on the ground this view shows the device as it would appear from above looking towards the ground.

FIG. 8 is a bottom up view of the invention of FIG. 1. The parts of the thrust bumper shown and labeled in FIG. 8. are comprised of a: proximal part 100; a distal part 200; a midsection 300; distal exterior edge 400; proximal exterior edge 500; proximal interior edge 1000; interior wall 1100; distal exterior edge groove 1500; scrotal port exterior edge 1800; and, scrotal port interior wall 2000. This view is referred to as a bottom up view, because when the penetrating party dons the device and is standing on the ground this view shows the device as it would appear viewed from the ground looking up.

FIG. 9 is a cutaway view of the top down view of FIG. 7 of the invention of FIG. 1. The parts of the thrust bumper shown and labeled in FIG. 9. are comprised of a: proximal exterior edge 500; distal inner edge 900; proximal interior edge 1000; interior wall 1100; distal edge of urethral channel 1200; interior urethral channel 1300; distal interior edge groove 1600; urethral channel sidewall 1700; scrotal port inner wall 2000; penile port 2300; proximal surface 4400; and, thrust bumper horizontal section 4500.

FIG. 10 is a cutaway view of the proximal up view of FIG. 8 of the invention of FIG. 1. The parts of the thrust bumper shown and labeled in FIG. 10. are comprised of a: distal inner edge 900; proximal interior edge 1000; interior wall 1100; penile port 2300; and, thrust bumper horizontal section 4500.

Figure 11:
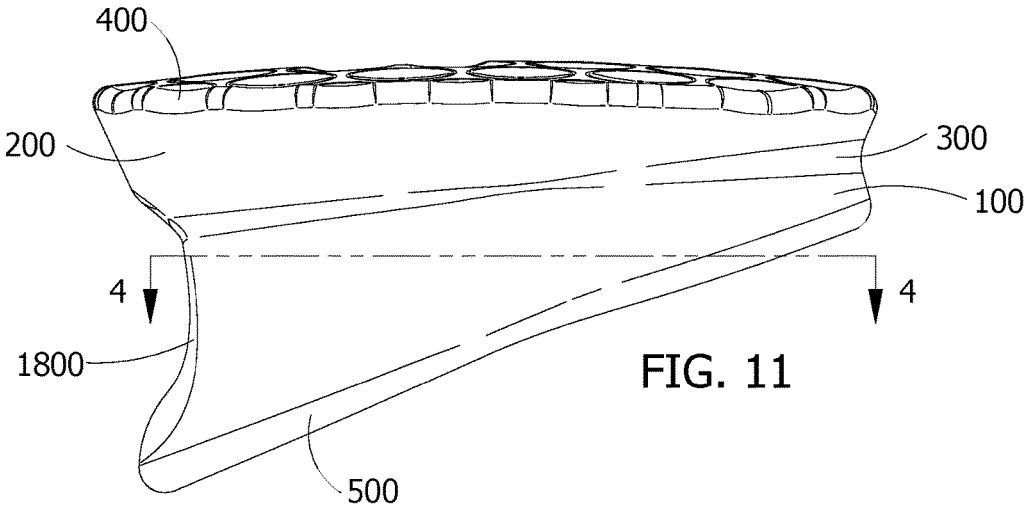
FIG. 11 is a side view of the invention of FIG. 1 wherein the distal side is facing upward and the proximal is to the left and top to the right.

FIG. 11 is a side view of the invention of FIG. 1 wherein the distal side is facing upward and the proximal is to the left and top to the right. The parts of the thrust bumper shown and labeled in FIG. 11. are comprised of a: proximal part 100; a distal part 200; a midsection 300; distal exterior edge 400; proximal exterior edge 500; and, scrotal port exterior edge 1800.

Figure 12:
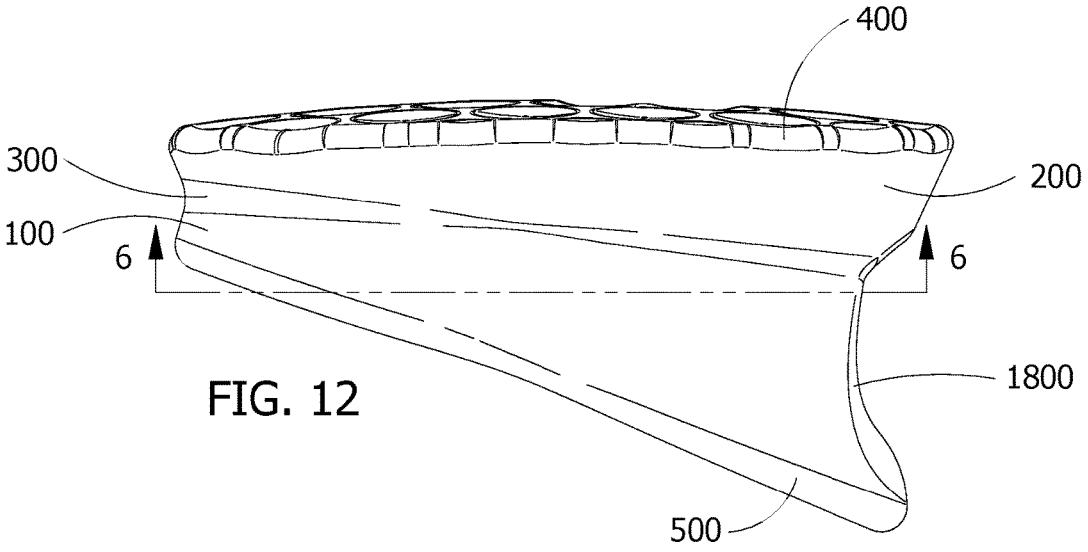
FIG. 12 is the opposite side view from FIG. 11 of the invention of FIG. 1.

FIG. 12 is the opposite side view from FIG. 11 of the invention of FIG. 1. The parts of the thrust bumper shown and labeled in FIG. 12. are comprised of a: proximal part 100; a distal part 200; a midsection 300; distal exterior edge 400; proximal exterior edge 500; and, scrotal port exterior edge 1800.

Figure 13:
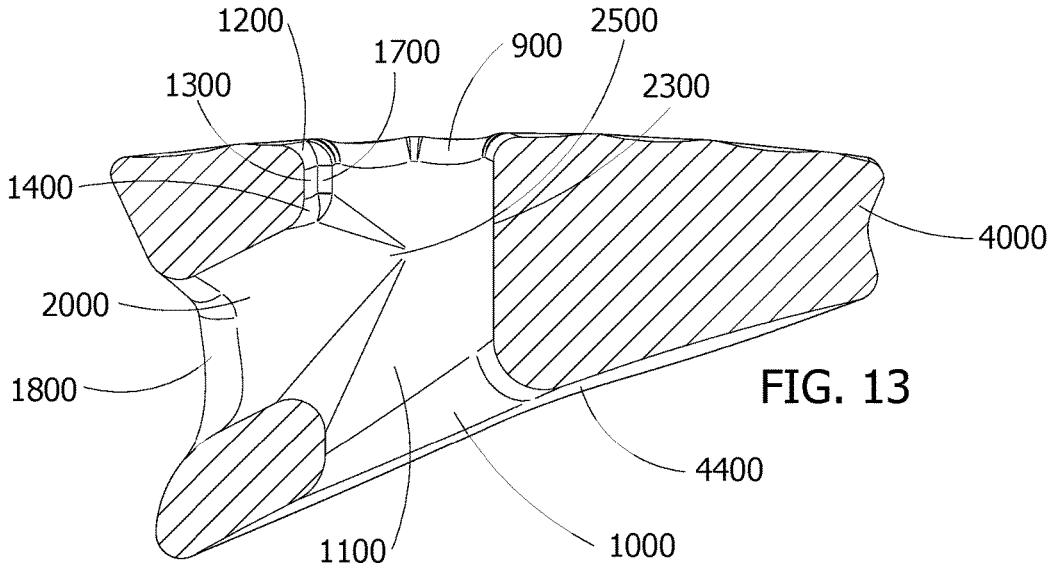
FIG. 13 is a cutaway view of FIG. 11 of the invention of FIG. 1.

FIG. 13 is a cutaway view of FIG. 11 of the invention of FIG. 1. The parts of the thrust bumper shown and labeled in FIG. 13. are comprised of a: distal inner edge 900; proximal interior edge 1000; interior wall 1100; distal edge of urethral channel 1200; interior urethral channel 1300; proximal urethral channel 1400; urethral channel sidewall 1700; scrotal port exterior edge 1800; scrotal port interior wall 2000; penile port 2300; thrust bumper core 4000; and, proximal surface 4400.

Figure 14:
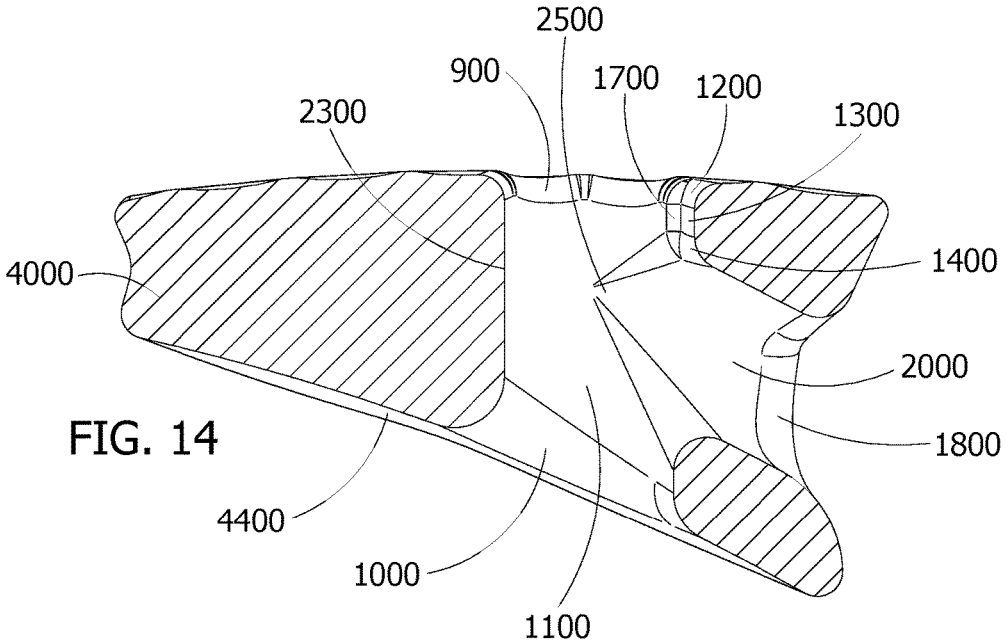
FIG. 14 is a cutaway view of FIG. 12 of the invention of FIG. 1.

FIG. 14 is a cutaway view of FIG. 12 of the invention of FIG. 1. The parts of the thrust bumper shown and labeled in FIG. 14. are comprised of a: distal inner edge 900; proximal interior edge 1000; interior wall 1100; distal edge of urethral channel 1200; interior urethral channel 1300; proximal urethral channel 1400; urethral channel sidewall 1700; scrotal port exterior edge 1800; scrotal port interior wall 2000; penile port 2300; thrust bumper core 4000; and, proximal surface 4400.

Figure 15:
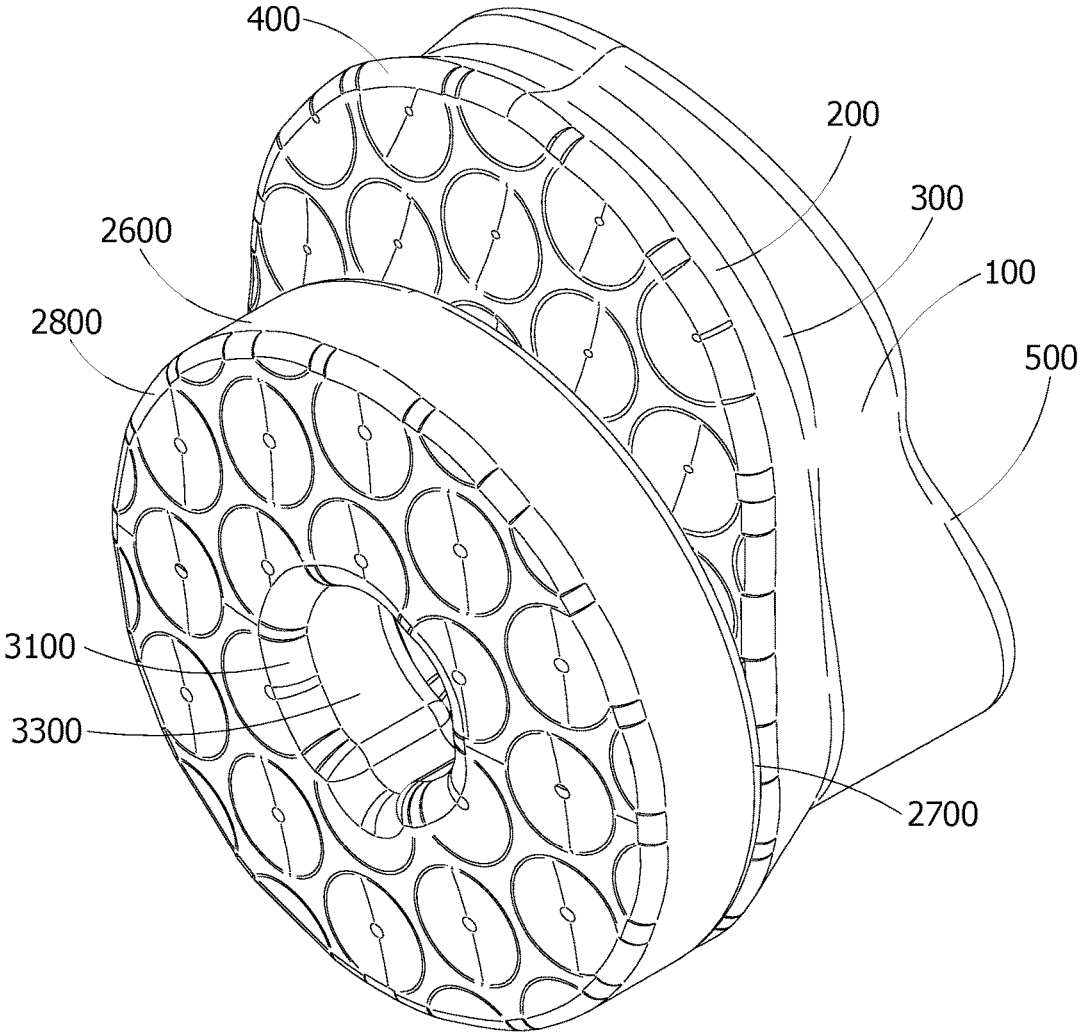
FIG. 15 is a distal view of the invention of FIG. 1 with the optional extension.

FIG. 15 is the distal view of the invention of FIG. 1 with the optional extension. The parts of the thrust bumper shown and labeled in FIG. 15. are comprised of a: proximal part 100; a distal part 200; a midsection 300; distal exterior edge 400; proximal exterior edge 500; buffer exterior sidewall 2600; buffer exterior proximal edge 2700; buffer exterior distal edge 2800; buffer distal inner edge 3100; and, buffer interior wall 3300. The extension may be formed as a single until with the base thrust bumper shown in FIGS. 1-14, or in some embodiments the buffer is separable as shown in the FIG. 16.

Figure 16:
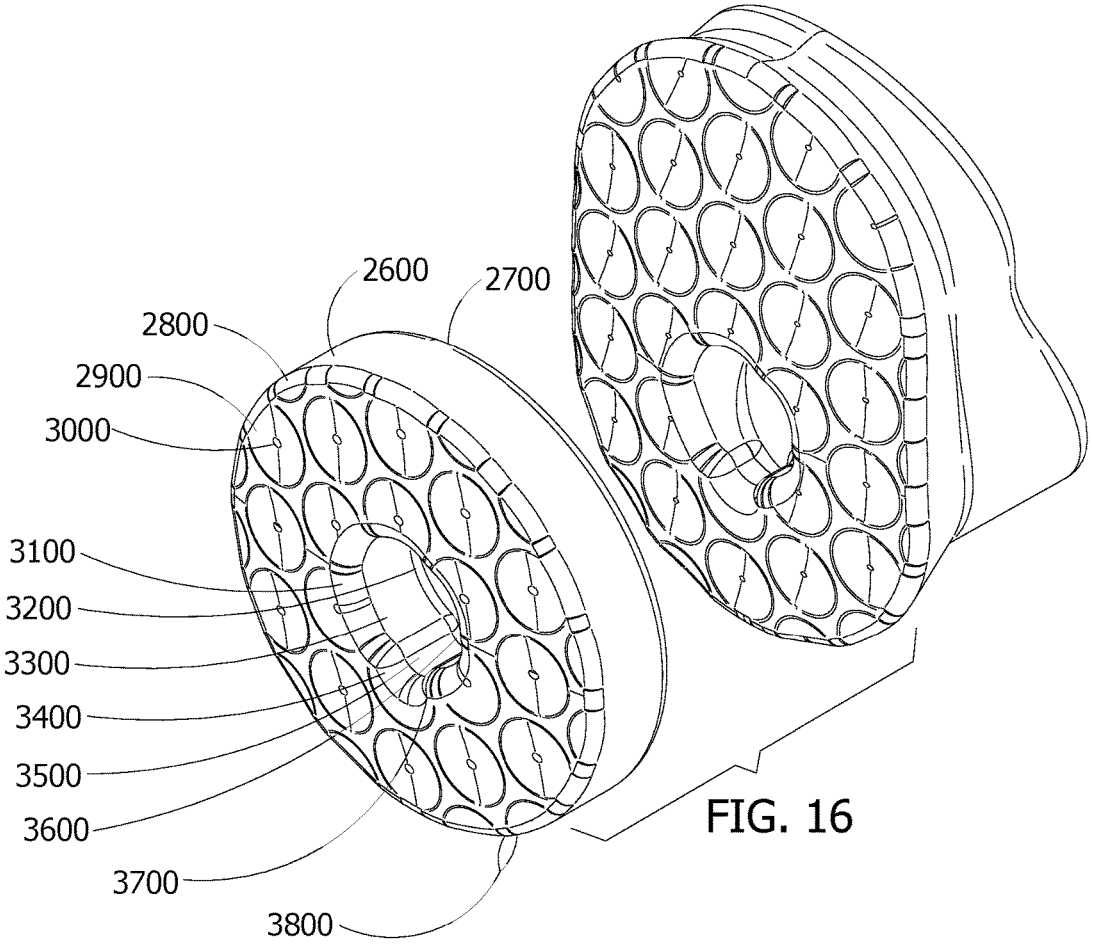
FIG. 16 is an expanded view showing separation of the distal view of the invention of FIG. 1 with the optional extension.

FIG. 16 is an expanded view showing separation of the distal view of the invention of FIG. 1 with the optional extension. The parts of the thrust bumper shown and labeled in FIG. 16. are comprised of a: buffer exterior sidewall 2600; buffer exterior proximal edge 2700; buffer exterior distal edge 2800; buffer exterior surface mound 2900; buffer exterior surface mound center 3000; buffer distal inner edge 3100; buffer proximal inner edge 3200; buffer interior wall 3300; buffer distal edge of the urethral channel 3400; buffer interior urethral channel 3500; buffer proximal urethral channel 3600; buffer interior edge groove 3700; and, buffer exterior edge groove 3800. As shown in FIG. 16 the buffer is optionally detachable from a thrust bumper. Although only one buffer and one thrust bumper are shown in FIG. 16 multiple buffers and/or thrust bumpers can be stacked on each other. The system is expandable.

Figure 17:
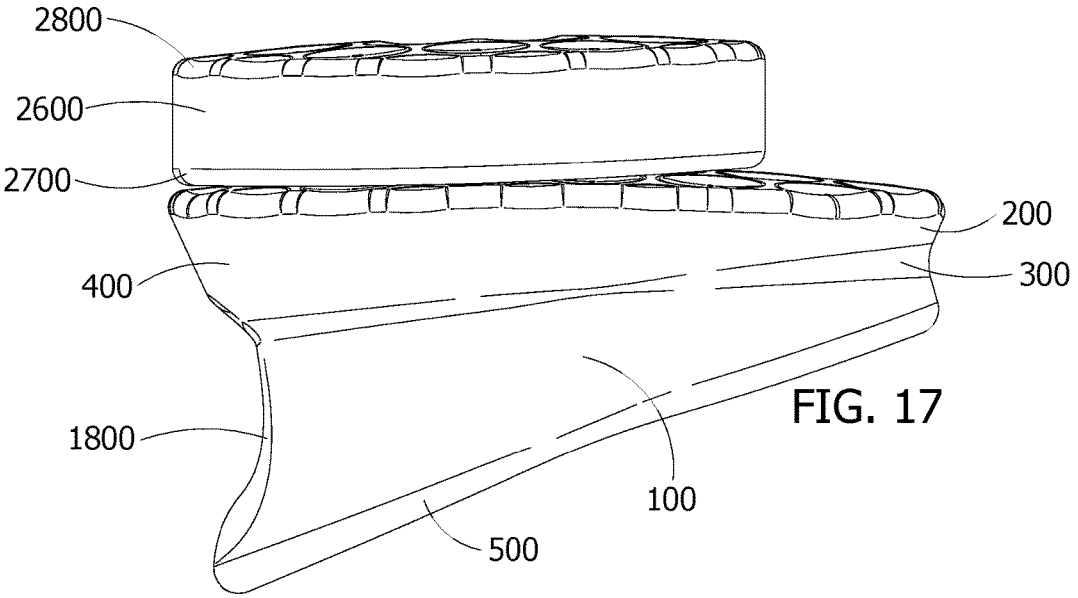
FIG. 17 is a side view of FIG. 11 showing the invention of FIG. 1 with the optional extension.

FIG. 17 is the side view of FIG. 11 showing the invention of FIG. 1 with the optional extension. The parts of the thrust bumper shown and labeled in FIG. 17. are comprised of a: proximal part 100; a distal part 200; a midsection 300; distal exterior edge 400; proximal exterior edge 500; scrotal port exterior edge 1800; buffer exterior sidewall 2600; buffer exterior proximal edge 2700; and, buffer exterior distal edge 2800.

Figure 18:
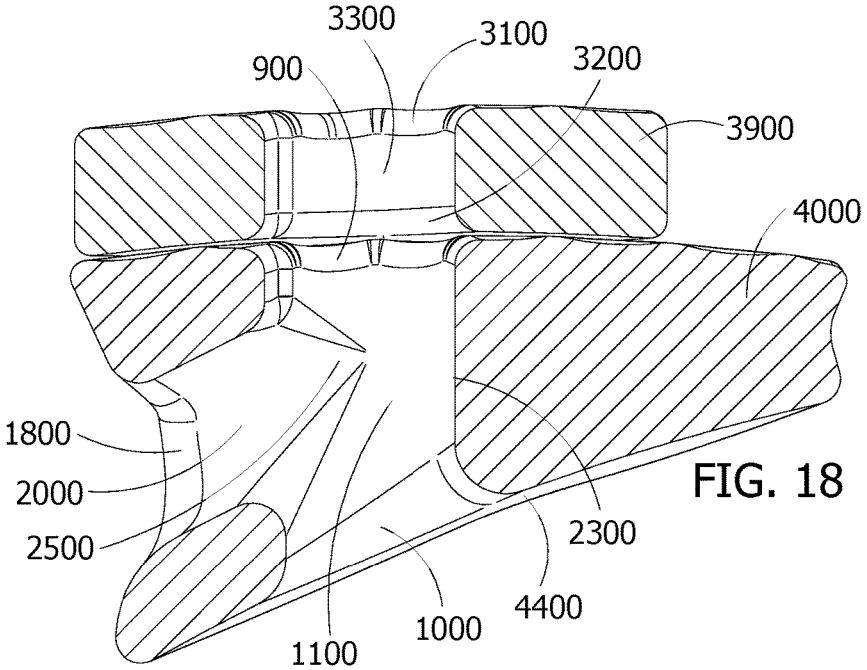
FIG. 18 is a cutaway of the side view of FIG. 17 showing the invention of FIG. 1 with the optional extension.

FIG. 18 is a cutaway of the side view of FIG. 17 showing the invention of FIG. 1 with the optional extension. The parts of the thrust bumper shown and labeled in FIG. 13. are comprised of a: distal inner edge 900; proximal interior edge 1000; interior wall 1100; distal edge of urethral channel 1200; interior urethral channel 1300; proximal urethral channel 1400; urethral channel sidewall 1700; scrotal port exterior edge 1800; scrotal port interior wall 2000; penile port 2300; buffer distal inner edge 3100; buffer proximal inner edge 3200; buffer interior wall 3300; buffer core 3900; thrust bumper core 4000; and, proximal surface 4400.

Figure 19:
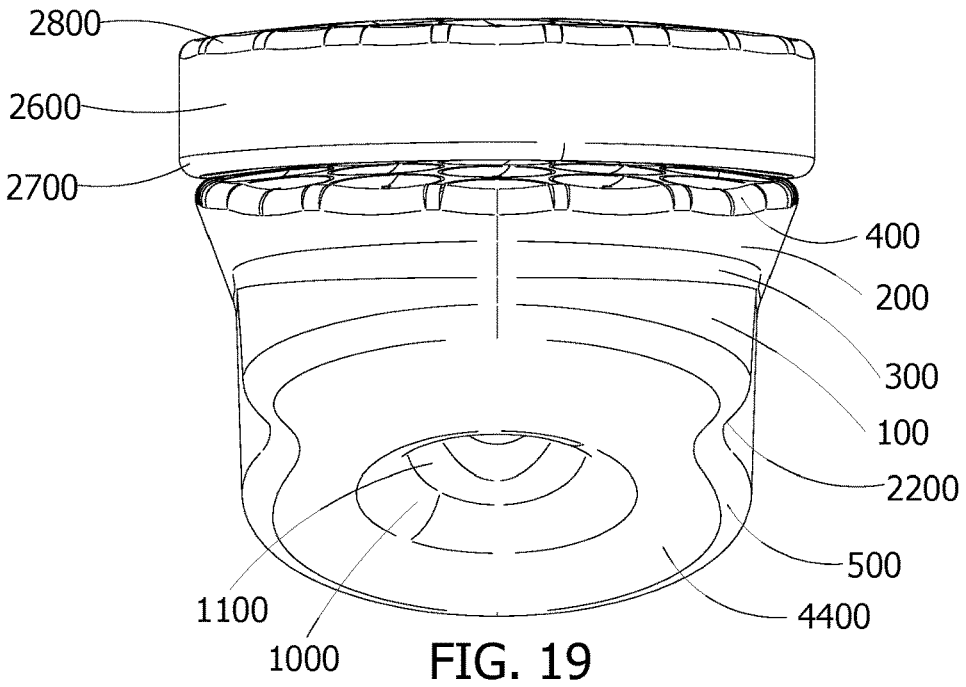
FIG. 19 is a top down view of FIG. 7 with the optional extension.

FIG. 19 is the top down view of FIG. 7 with the optional extension. The parts of the thrust bumper shown and labeled in FIG. 7. are comprised of a: proximal part 100; a distal part 200; a midsection 300; distal exterior edge 400; proximal exterior edge 500; proximal interior edge 1000; interior wall 1100; indention of the base wall 2200; buffer exterior sidewall 2600; buffer exterior proximal edge 2700; buffer exterior distal edge 2800; and, proximal surface 4400.

Figure 20:
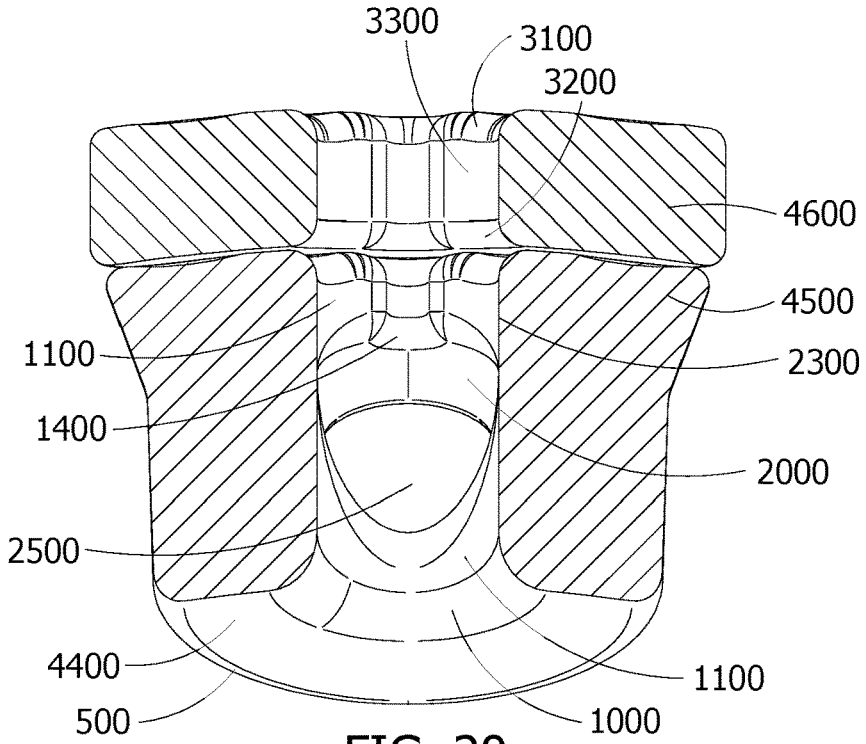
FIG. 20 is a cutaway of the top down view of FIG. 19.

FIG. 20 is a cutaway of the top down view of FIG. 19 of the invention of FIG. 1. The parts of the thrust bumper shown and labeled in FIG. 20. are comprised of a: proximal exterior edge 500; proximal inner edge 1000; interior wall 1100; proximal urethral channel 1400; scrotal port inner wall 2000; penile port 2300; buffer distal inner edge 3100; buffer proximal inner edge 3200; buffer interior wall 3300; thrust bumper horizontal section 4500; and, buffer horizontal section 4600.

Figure 21:
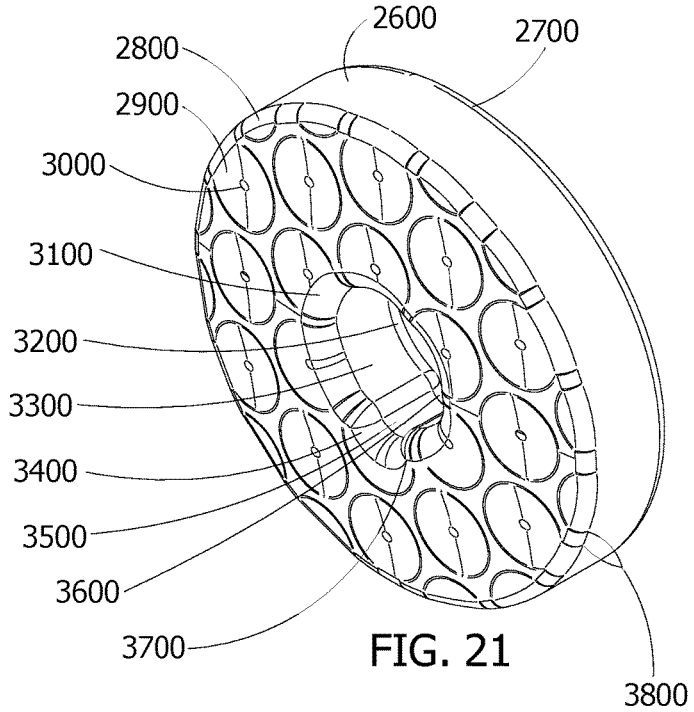
FIG. 21 is an elevated distal view of the option extension only.

FIG. 21 is an elevated distal view of the optional extension only. The parts of the thrust bumper shown and labeled in FIG. 21. are: buffer exterior sidewall 2600; buffer exterior proximal edge 2700; buffer exterior distal edge 2800; buffer exterior surface mound 2900; buffer exterior surface mound center 3000; buffer distal inner edge 3100; buffer proximal inner edge 3200; buffer interior wall 3300; buffer distal edge of the urethral channel 3400; buffer interior urethral channel 3500; buffer proximal urethral channel 3600; buffer interior edge groove 3700; and, buffer exterior edge groove 3800.

Figure 22:
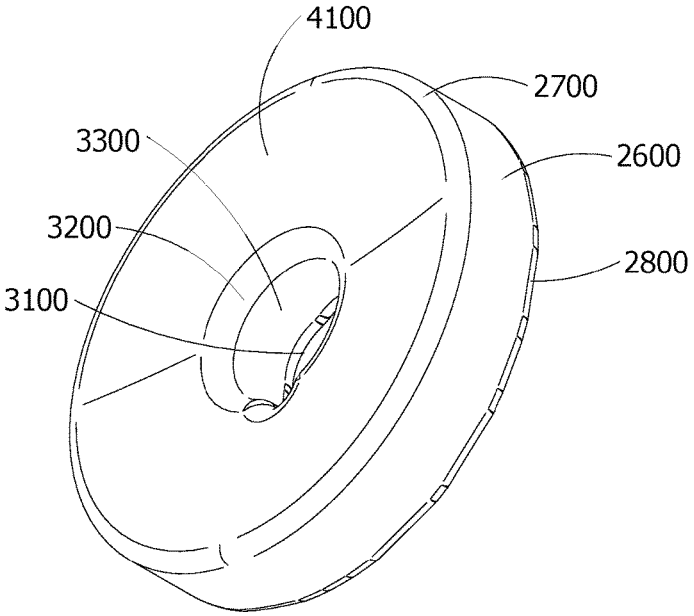
FIG. 22 is an elevated proximal view of the optional extension of FIG. 21.

FIG. 22 is an elevated proximal view of the optional extension of FIG. 21. The parts of the thrust bumper shown and labeled in FIG. 22. are: buffer exterior sidewall 2600; buffer exterior proximal edge 2700; buffer exterior distal edge 2800; buffer distal inner edge 3100; buffer proximal inner edge 3200; buffer interior wall 3300; and, buffer proximal surface 4100.

Figure 23:
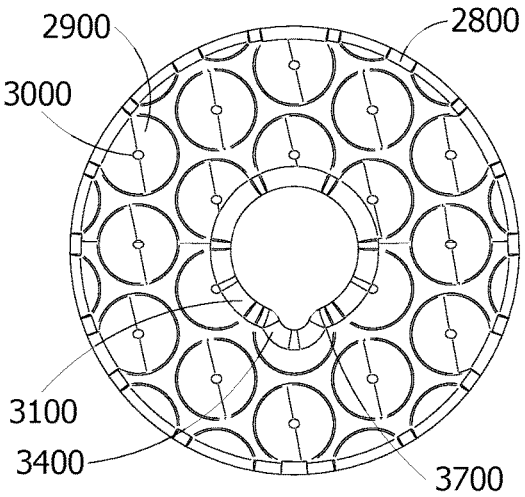
FIG. 23 is a distal view of the optional extension of FIG. 21.

FIG. 23 is a distal view of the optional extension of FIG. 21. The parts of the thrust bumper shown and labeled in FIG. 23. are: buffer exterior distal edge 2800; buffer exterior surface mound 2900; buffer exterior surface mound center 3000; buffer distal inner edge 3100; buffer distal edge of the urethral channel 3400; and, buffer interior edge groove 3700.

Figure 24:
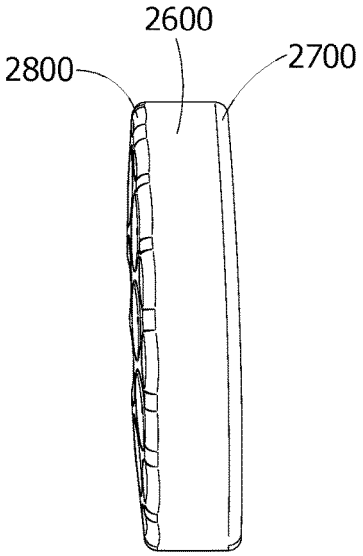
FIG. 24 is a side view of the optional extension of FIG. 21.

FIG. 24 is a side view of the optional extension of FIG. 21. The parts of the thrust bumper shown and labeled in FIG. 24. are: buffer exterior sidewall 2600; buffer exterior proximal edge 2700; and, buffer exterior distal edge 2800.

Figure 25:
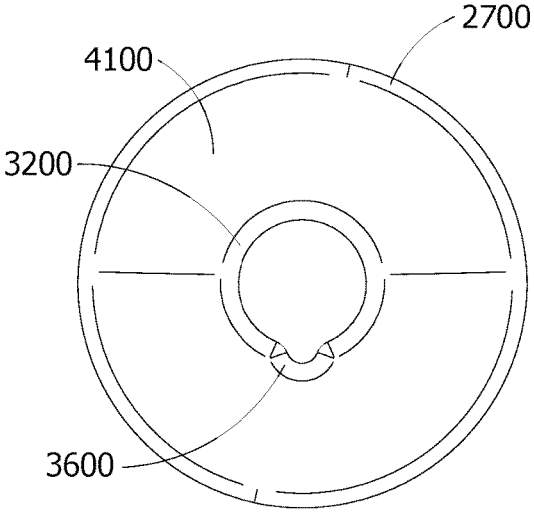
FIG. 25 is a proximal view of the option extension of FIG. 21.

FIG. 25 is a proximal view of the option extension of FIG. 21. The parts of the thrust bumper shown and labeled in FIG. 25. are: buffer exterior proximal edge 2700; buffer proximal inner edge 3200; buffer proximal urethral channel 3600; and, buffer proximal surface 4100.

Figure 26:
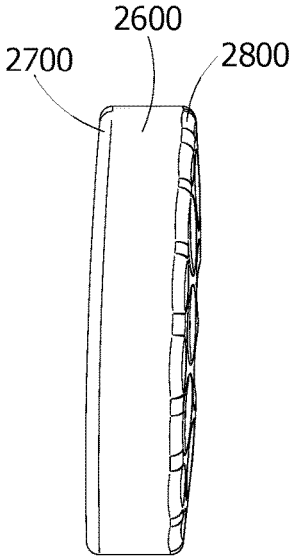
FIG. 26 is the opposite side view from FIG. 24 of the optional extension of FIG. 21.

FIG. 26 is the opposite side view from FIG. 24 of the optional extension of FIG. 21. The parts of the thrust bumper shown and labeled in FIG. 26. are: buffer exterior sidewall 2600; buffer exterior proximal edge 2700; and, buffer exterior distal edge 2800.

FIG. 27 shows a thrust bumper as donned, included in the drawing are a representative phallus 4200; and scrotum 4300.

FIG. 28 is cross sectional view of a donned thrust bumper. shown are: thrust bumper core 4000; phallus 4200; and, scrotum 4300.

The internal edges of the a thrust bumper and its optional extenders such as: distal inner edge 900; proximal inner edge 1000; distal edge of urethral channel 1200; proximal urethral channel 1400; scrotal port exterior edge 1800; scrotal port interior edge 1900; proximal scrotal port exterior edge 2400; buffer distal edge 3100; buffer proximal inner edge 3200; buffer distal edge of the urethral channel 3400; and, buffer proximal urethral channel 3600 are preferably smooth and beveled/rounded. Preferably the edges are eased, but bullnose, ogee, straight and other forms of edge may be used. The rounded edges generally provide greater comfort and make it easier for a user to don a thrust bumper and prevent chaffing. The optional grooves, for example: distal interior edge groove 1600; and buffer interior edge groove 3700 and/or other texture applied to the edges also help to prevent shifting of the device and/or chaffing during use. The grooves also enable better grip.

Similar beveling and grooving/texturing of the exterior edges also provides a comfortable fit while enabling better grip for donning and removing the device. Examples of various embodiments of external edges and groves are shown in the figures, such as: distal exterior edge 400; proximal exterior edge 500 the distal exterior edge groove 1500; buffer exterior proximal edge 2700; buffer exterior distal edge 2800; buffer exterior edge groove 3800; etc.

In order to don a thrust bumper, the giving and/or penetrating partner inserts his/her penis/phallus 4200 and/or appendage through the penile port 2300. In a preferred embodiment the penetrating partner also inserts his testicles so that the testicles and scrotum 4300 descend through the scrotal port. The scrotal port exterior edge 1800, scrotal port inner edge 1900, and scrotal port inner wall 2000 surround the scrotal port. The scrotal port is connected to the penile port 2300 through the interior penile and scrotal port trans-channel 2500. This configuration enables hands free use, stability and stimulation of the scrotum 4300 and testicles during intercourse.

In yet another embodiment, a penile port 2300 provides a urethral channel to avoid restricting flow of blood, semen and urine. The urethral channel also provides a guide for the user for proper alignment and a snug comfort fit. The urethral channel is surrounded by the distal edge of urethral channel 1200, interior urethral channel 1300, proximal urethral channel 1400, and urethral channel sidewall 1700. The urethral channel is generally aligned parallel to and forms a portion of the penile port 2300. Alternatively, in some embodiments the penile port 2300 and/or scrotal ports are narrowed in order to provide erection ring type support for longer sex and greater engorgement of the penis. This is particularly useful when the donning/penetrating partner suffers from erectile dysfunction, premature ejaculation, and/or is recovering from prior climax.

While results vary slightly across reputable studies, the consensus is that the mean human penis, when erect, is in the range 12.9-15 cm (5.1-5.9 in) in length. The average girth is about four and fifty nine one-hundredths (4.59) inches in circumference Consequently, the desired thickness of a thrust bumper from the proximal end of the penile port to the distal side should generally be less than five (5) inches. In most applications, two (2) inches or less is desired. Buffer thickness, also measured from proximal to distal side should generally be less than two (2) inches, but an one eighth (⅛) of an inch or greater. Both the thrust bumper and buffer should generally have penile ports were the circumference is at least approximately one and one-half (1.5) inches and generally less than seven (7) inches. In most applications between four (4) to six (6) inches of circumference is desired. The most common width being approximately one and one-half (1.5) inches or just under five (5) inches in circumference. However, some thrust bumper shapes and size may exceed or fall outside the generally recommended rages.

Having thus described preferred embodiments, it should be apparent to those skilled in the art that certain advantages of the described system have been achieved. It should also be appreciated that various modifications, adaptions, and alternative embodiments thereof may be made within the scope and spirit of the present invention. The invention is further defined by the following claims.

What is claimed is:

1. A thrust bumper comprising:
an outer surface comprising a:
a distal surface; and,
a proximal surface;
a midsection;
a proximal part;
a distal part;
a distal exterior edge;
a proximal exterior edge;
a penile port; and
a scrotal port;
the scrotal port connected to the penile port through a penile and scrotal port trans-channel;
wherein the penile port is an opening within the distal surface and proximal surface that traverses through the proximal surface, midsection and distal surface within a range of an eighth of an inch to five inches; and
wherein together the proximal part, the distal part, the midsection, the distal exterior edge, the proximal exterior edge and the outer surface form a wedge shape adapted to cushion thrusts during sexual intercourse.

2. The thrust bumper of claim 1, further comprising:
a urethral channel aligned with said penile port.

3. The thrust bumper of claim 2, further comprising:
a beveled proximal edge of the penile port.

4. The thrust bumper of claim 3, further comprising:
a beveled proximal edge of the urethral channel.

5. The thrust bumper of claim 4, further comprising:
a beveled proximal exterior edge.

6. The thrust bumper of claim 5, further comprising:
one or more indentations of the proximal part.

7. The thrust bumper of claim 6, further comprising:
the outer surface based in part of silicone.

8. The thrust bumper of claim 7 further comprising:
a buffer extension that is less than three inches thick as measured from a proximal surface of the buffer extension to a distal surface of the buffer extension.

9. The thrust bumper of claim 8 where said buffer extension is of a toroidal shape.

10. The thrust bumper of claim 9 where the distal surface of the thrust bumper comprises:
one or more surface mounds.

11. The thrust bumper of claim 10 where the proximal surface of the buffer extension comprises:
one or more surface mounds.

* * * * *